US012539012B2

(12) United States Patent
Han et al.

(10) Patent No.: US 12,539,012 B2
(45) Date of Patent: Feb. 3, 2026

(54) DISHWASHER

(71) Applicant: LG Electronics Inc., Seoul (KR)

(72) Inventors: Shinwoo Han, Seoul (KR); Sangheon Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 126 days.

(21) Appl. No.: 18/265,866

(22) PCT Filed: Dec. 6, 2021

(86) PCT No.: PCT/KR2021/018352
§ 371 (c)(1),
(2) Date: Jun. 7, 2023

(87) PCT Pub. No.: WO2022/124728
PCT Pub. Date: Jun. 16, 2022

(65) Prior Publication Data

US 2024/0057843 A1 Feb. 22, 2024

(30) Foreign Application Priority Data

Dec. 7, 2020 (KR) ..... 10-2020-0169726

(51) Int. Cl.
*A47L 15/06* (2006.01)
*A47L 15/20* (2006.01)
(Continued)

(52) U.S. Cl.
CPC ..... *A47L 15/22* (2013.01); *A47L 15/06* (2013.01); *A47L 15/20* (2013.01);
(Continued)

(58) Field of Classification Search
None
See application file for complete search history.

(56) References Cited

U.S. PATENT DOCUMENTS

2011/0139181 A1 6/2011 Lee et al.
2013/0255733 A1* 10/2013 Ju ..... A47L 15/23 134/179
2019/0290094 A1 9/2019 Balinski et al.

FOREIGN PATENT DOCUMENTS

CN 204467992 U 7/2015
CN 204671085 U 9/2015
(Continued)

OTHER PUBLICATIONS

Extended European Search Report in European Appln. No. 21903774.4, mailed on Sep. 19, 2024, 9 pages.
(Continued)

*Primary Examiner* — Levon J Shahinian
(74) *Attorney, Agent, or Firm* — Fish & Richardson P.C.

(57) ABSTRACT

Disclosed is a dishwasher including: a washing tub in which a rack on which a washing object is seated is disposed; a spray tube which has a rotation shaft extending in a direction intersecting upper and lower shafts, and has a spray nozzle disposed therein to eject flowing washing water in a direction intersecting the rotation shaft; a power applying device that generates power; and a driving module connected to the spray tube so that the power generated by the power applying device is transmitted to the spray tube, wherein the driving module includes: a rotation body which is connected to the power applying device; a pendulum body extending from the spray tube in a direction intersecting the rotation shaft; and a conversion link connected to the rotation body and the pendulum body to convert rotational motion of the rotation body into pendulum motion of the pendulum body.

20 Claims, 13 Drawing Sheets

(51) Int. Cl.
*A47L 15/22* (2006.01)
*A47L 15/42* (2006.01)
*A47L 15/50* (2006.01)

(52) U.S. Cl.
CPC ..... *A47L 15/4214* (2013.01); *A47L 15/4278* (2013.01); *A47L 15/428* (2013.01); *A47L 15/50* (2013.01); *A47L 2601/02* (2013.01); *A47L 2601/16* (2013.01)

(56) References Cited

FOREIGN PATENT DOCUMENTS

| | | | |
|---|---|---|---|
| GB | 977585 | A | 12/1964 |
| GB | 990333 | A | 4/1965 |
| GB | 1123787 | A | 8/1968 |
| JP | 2004-000654 | | 1/2004 |
| KR | 10-2013-0042124 | A | 4/2013 |
| KR | 10-2017-0021641 | | 2/2017 |
| KR | 10-1890623 | | 8/2018 |
| KR | 10-2022850 | | 9/2019 |

OTHER PUBLICATIONS

Office Action in Korean Appln. No. 10-2020-0169726, mailed on Nov. 20, 2025, 12 pages (with English 1 translation).

* cited by examiner

DISHWASHER

CROSS-REFERENCE TO RELATED APPLICATIONS

This application is a National Stage application under 35 U.S.C. § 371 of International Application No. PCT/KR2021/018352, filed on Dec. 6, 2021, which claims the benefit of Korean Patent Application No. 10-2020-0169726, filed on Dec. 7, 2020. The disclosures of the prior applications are incorporated by reference in their entirety.

TECHNICAL FIELD

The present disclosure relates to a dishwasher, and more particularly, to a spray tube through which washing water is sprayed.

BACKGROUND ART

A dishwasher is an apparatus that sprays washing water and steam on a washing object accommodated inside a cabinet to remove foreign substances and bacteria attached to the washing object.

A spray tube for spraying washing water is disposed in a rack on which a washing object is seated, and a spray nozzle opened toward the rack is formed in the spray tube.

However, as a spray nozzle continuously sprays washing water toward a specific direction of a rack during a washing operation, there is a problem in that washing is concentrated on a specific part of the washing object.

Korean Registered Patent No. 10-1528059 discloses a rotation module that rotates a rack itself on which a washing object is seated so that washing water is evenly sprayed on an entire part of the washing object, but there is a problem that an excessive capacity motor is required due to the weight of the washing object.

U.S. patent application Ser. No. 16/050,146 discloses a method of rotating a spray tube by the flow of washing water, but there is a problem in that as the spray tube continues to rotate in a uniform direction, an area, which is rotated while the spray nozzle does not face the washing object, occurs, thereby wasting washing water.

DISCLOSURE

Technical Problem

An object of the present disclosure is to provide a dishwasher in which washing water is evenly sprayed.

Another object of the present disclosure is to provide a dishwasher having a spray tube rotating in both directions.

Another object of the present disclosure is to provide a dishwasher equipped with a spray tube for easy adjustment of a rotation radius.

Another object of the present disclosure is to provide a dishwasher in which the amount of wasted washing water is reduced.

Another object of the present disclosure is to provide a dishwasher equipped with a spray tube in which power required for rotation is minimized.

Another object of the present disclosure is to provide a dishwasher equipped with a spray tube that continuously reciprocates and rotates with a single power source.

The tasks of the present disclosure are not limited to the tasks mentioned above, and other tasks not mentioned will be clearly understood by those skilled in the art from the following description.

Technical Solution

In order to achieve the above object, a dishwasher according to an embodiment of the present disclosure includes: a washing tub in which a rack on which a washing object is seated is disposed; and a spray tube which has a rotation shaft extending in a direction intersecting upper and lower shafts.

The spray tube has a spray nozzle disposed therein to eject flowing washing water in a direction intersecting the rotation shaft, so that washing water may be supplied toward the rack through a plurality of spray nozzles.

The dishwasher includes: a power applying device that generates power; and a driving module connected to the spray tube so that the power generated by the power applying device is transmitted to the spray tube, so that the spray tube can be moved by the power generated by a power applying device.

The driving module includes: a rotation body which is connected to the power applying device and rotated; a pendulum body that has one end connected to the spray tube and extends from the one end in a direction intersecting the spray tube, and has the other end, which is spaced apart from the one end, that perform pendulum motion around the rotation shaft; and a conversion link connected to the rotation body and the pendulum body to convert rotational motion of the rotation body into pendulum motion of the pendulum body, so that the spray tube can be reciprocally rotated by converting the rotational motion of the rotation body into the pendulum motion of the pendulum body.

The conversion link includes: a first link which is connected to the rotation body, and moves along a circumferential direction of the rotation body; and a second link connected to the first link and the pendulum body to move relative to each other, so that the driving module can implement a four-bar link motion as the second link has a degree of freedom of movement with respect to the first link and the pendulum body.

The first link is formed to protrude a first joint connected to the second link, and the second link has a second joint groove into which the pendulum link is inserted, and is bent at least once between the first joint and the second joint groove, so that a power transmission path through the second link may be reduced.

A plurality of spray tubes are disposed to be spaced apart in a length direction of the rack, a plurality of pendulum bodies are disposed to be connected to the plurality of spray tubes respectively, and the second link is connected to each of the plurality of pendulum bodies, so that a plurality of spray tubes can be rotated with a single driving force.

The second link includes: a first frame which extends in an up-down direction, and is connected to the first link; and a second frame which extends in a direction intersecting the first frame, and is connected to the pendulum body, so that the power transmission path through the second link can be minimized.

A length of the first frame is shorter than a length of the second frame, so that loss of power transmitted from the rotation body can be minimized.

The rotation body includes: a power shaft connected to the power applying device; and a third joint groove which is formed in a position spaced apart from the power shaft in a radial direction, and into which the first link is inserted, so that the first link may be rotated eccentrically.

The first link is formed to protrude a first joint connected to the second link and a third joint connected to the rotation body, the pendulum body is formed to protrude a second joint connected to the second link, and the third joint moves along the circumferential direction of the rotation body to change a relative vertical position with respect to the first joint, and is located higher than the second joint, so that the power transmission direction through the first link and the second link may be formed downward.

The second joint is connected to the second link at an upper side of the rotation shaft, and performs a pendulum motion around the rotation shaft, so that the pendulum link and the spray tube may be reciprocally rotated around the rotation shaft.

The spray tube has a connector protruding toward the pendulum body, and the pendulum body has a pendulum body hole into which the connector is inserted, so that the spray tube and the pendulum body may be coupled as one body.

The pendulum body includes: a holder extending to surround the pendulum body hole, and a pendulum link extending from the holder in a direction intersecting the spray tube, so that the bond between the pendulum body and the spray tube can be strengthened.

The power applying device includes an impeller having a plurality of blades spaced apart from each other in a circumferential direction, so that rotational power of the impeller may be transmitted to the driving module.

The washing water extruded from the washing pump is branched and flows toward the spray tube and the impeller, so that the hydraulic power of the washing water extruded from the washing pump can be used as power.

The power applying device includes a gear train having a driven gear connected to the rotation body and a driving gear engaged with the driven gear, so that the rotational speed of the rotation body can be adjusted through the gear train.

The dishwasher further includes a blocking block in which the power applying device and the driving module are disposed, and the power applying device is disposed in one side of the blocking block, and the driving module is disposed in the other side of the blocking block, so that sealing between the power applying device and the driving module may be performed.

The blocking block has a recessed groove formed in one side on which the driving module is disposed, and the rotation body is disposed within the groove, so that removal of the rotation body can be prevented.

The rack includes: a first wire extending obliquely upward; and a second wire which extends obliquely upward to intersect the first wire, and forms a spray space between the first wire and the second wire, and the spray tube is disposed in the spray space, so that the disposition space of the spray tube and the rack can be used compactly.

The blocking block has a fastening boss which protrudes toward the rack and is connected to the rack, so that the driving module and the power applying device can be connected to the rack.

The dishwasher further includes a supporter disposed spaced apart from the driving module in a width direction of the spray tube, and the supporter includes: a support block connected to the rack; and a bearing which is fixedly disposed in the support block and rotatably connected to the spray tube, so that the spray tube can be supported from both sides.

The spray nozzle includes: a first spray wall extending from the spray tube toward the rack; and a second spray wall obliquely extending from the first spray wall toward the rack, so that washing water may be sprayed radially through the spray nozzle.

Details of other embodiments are included in the detailed description and drawings.

Advantageous Effects

According to the dishwasher of the present disclosure, one or more of the following effects are provided.

First, there is an advantage in that the washing water can be evenly sprayed to the washing object, by reciprocating and rotating the spray tube through the driving module.

Second, there is an advantage in that the spray tube can be moved in both directions, by connecting a pendulum link that is pendulum-moving to the spray tube.

Third, there is an advantage in that the rotation radius of the spray tube can be easily adjusted, by adjusting the connection structure of the rotation body, the first link, the second link, and the pendulum body.

Fourth, there is an advantage in that the amount of wasted washing water can be reduced, by adjusting the rotation radius of the pendulum body so that the spray nozzle always faces the rack.

Fifth, there is an advantage in that the power required for rotation of the spray tube can be minimized, by configuring the structure of the second link with a plurality of frames and reciprocating and rotating the plurality of spray tubes through a single power source.

The effects of the present disclosure are not limited to the effects mentioned above, and other effects not mentioned can be clearly understood by those skilled in the art from the description of the claims.

MODE FOR INVENTION

Figure 1:
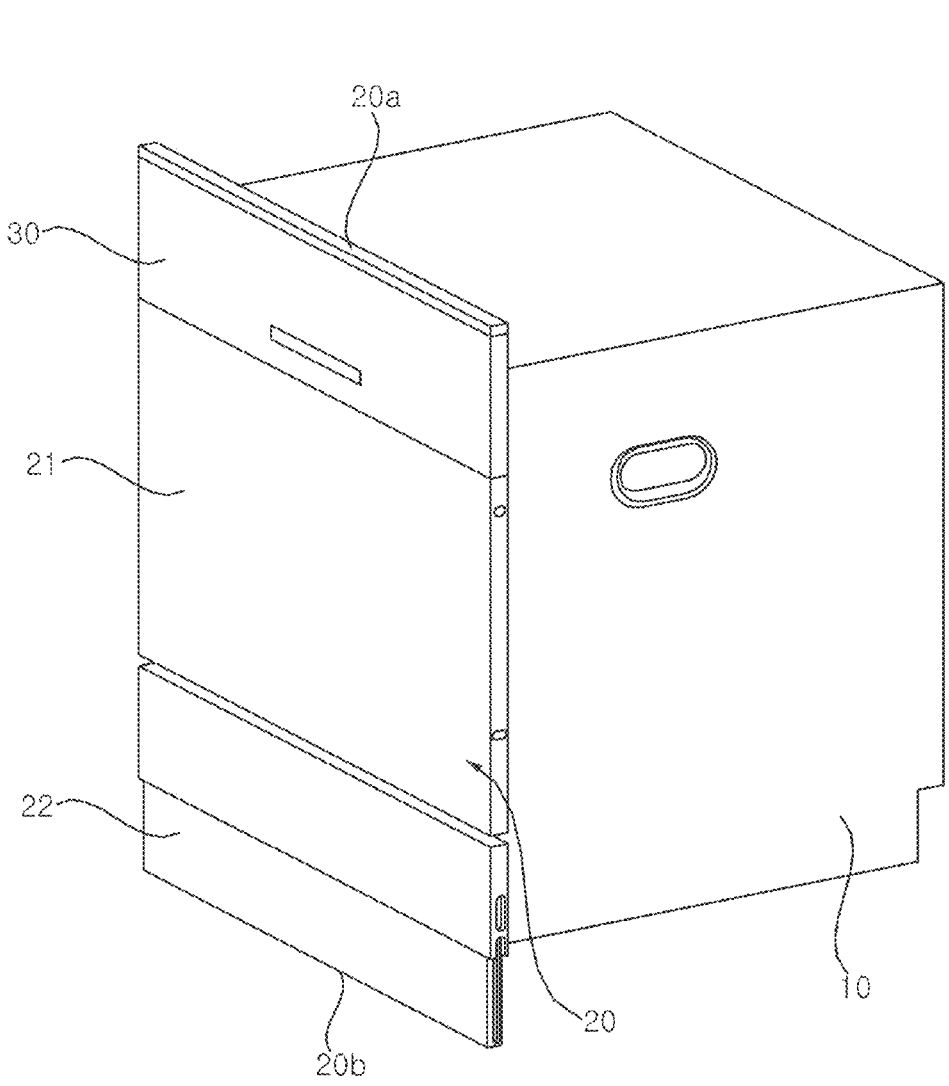
FIG. 1 is a perspective view of a dishwasher according to an embodiment of the present disclosure.

Advantages and features of the present disclosure and methods of achieving them will become apparent with reference to the embodiments described in the lower side of in detail in conjunction with the accompanying drawings. However, the present disclosure is not limited to the embodiments disclosed in the lower side of, but may be implemented in various different forms, and these embodiments are provided only to allow the disclosure of the present disclosure to be complete, and to completely inform those of ordinary skill in the art to which the present disclosure belongs, the scope of the invention, and the present disclosure is only defined by the scope of the claims. Like reference numerals refer to like elements throughout.

Hereinafter, the present disclosure will be described with reference to drawings for explaining a dishwasher according to embodiments of the present disclosure.

Referring to FIG. 1, the overall outer shape of a dishwasher 1 will be described first. FIG. 1 shows the overall appearance of the dishwasher 1.

The dishwasher 1 includes a cabinet 10 that has a washing tub 100 (see FIG. 2) for accommodating a washing object therein, and a door 20 disposed in front of the cabinet 10.

The cabinet 10 may form the outer shape of the dishwasher 1, and may have a rectangular column shape. The front of the cabinet 10 may be opened, and a washing object may be loaded into the washing tub 100 through the opened portion of the cabinet 10.

The door 20 may open or close the opened portion of the cabinet 10. The door 20 may close the opened portion to seal the washing tub 100, and open the opened portion to allow the washing tub 100 to communicate with the outside of the cabinet 10.

The door 20 may be connected to the cabinet 10 so as to be movable in the up-down direction. The door 20 may include a door body 21 forming the outer shape of the door 20, and a lower door 22 connected to the door body 21 so as to be movable in the up-down direction.

The door body 21 may be disposed so as to be movable in the up-down direction with respect to the cabinet 10, and a guide member (not shown) for moving the door body 21 in the up-down direction may be disposed therein.

The lower end 20*b* of the lower door 22 may be the lowermost end of the door 20, and the lower door 22 may be disposed to protrude downward than the lower surface of the cabinet 10 by moving in the up-down direction from the door body 21.

The dishwasher 1 may include a control panel 30 connected to the door 20 so as to be movable in the up-down direction.

The control panel 30 may be a display capable of displaying driving information of the dishwasher 1 and selecting an operation course of the dishwasher 1.

The control panel 30 may be connected to the door 20 so as to be movable in the up-down direction, and constitute the front surface of the door 20.

The upper end 20*a* of the control panel 30 may be the uppermost end of the door 20, and the control panel 30 is disposed to protrude upward than the upper surface of the cabinet 10 by moving in the up-down direction from the door body 21.

Figure 2:
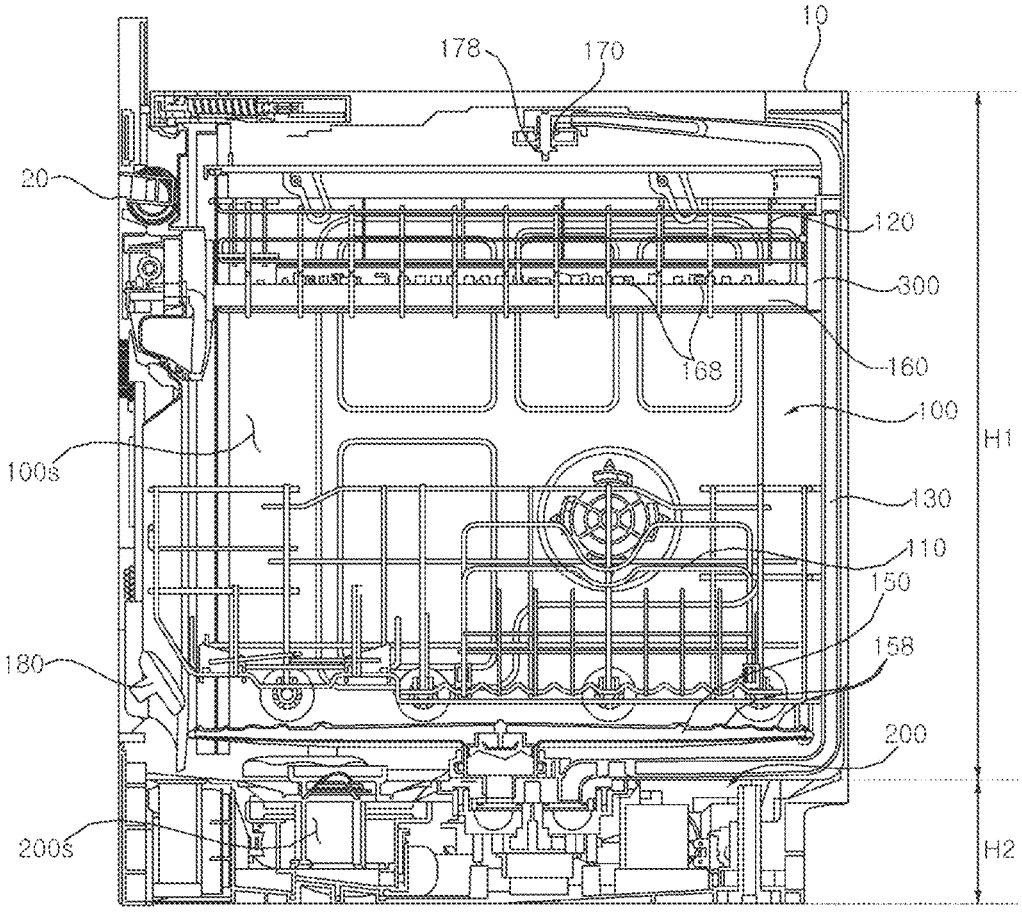
FIG. 2 is a longitudinal cross-sectional view of a dishwasher according to an embodiment of the present disclosure.

Hereinafter, the internal structure of the washing tub 100 will be described with reference to FIG. 2. FIG. 2 shows that the dishwasher 1 shown in FIG. 1 is cut in the up-down direction and viewed from the side.

In the washing tub 100, a washing object is accommodated and washing water is sprayed. The washing tub 100 is disposed inside the cabinet 10, and forms a washing space 100S in which a washing object is accommodated.

In the lower side of the washing tub 100, a driving unit 200 for circulating washing water is disposed. The driving unit 200 may be disposed inside the cabinet 10. The driving unit 200 forms a driving space 200S in which structures for circulation of washing water described later are disposed.

Inside the washing tub 100, an upper rack 120 on which a washing object is seated, and a lower rack 110 which is disposed in the lower side of the upper rack 120, and on which a washing object is seated may be disposed.

Inside the washing tub 100, a plurality of spray tube 150, 160, 170 may be disposed to spray washing water toward the washing object seated in the upper rack 120 and the lower rack 110.

The spray tube 150, 160, 170 may have a bar shape extending in the width direction of the rack 110, 120, and may have a rotation shaft extending in the width direction of the rack 110, 120.

The spray tube 150, 160, 170 may have a cross shape formed by crossing two types of frames disposed parallel to the rack 110, 120, and may have a rotation shaft extending in the up-down direction.

The spray tube 150, 160, 170 may have a tube shape and may be disposed in the lower side of the upper rack 120 or the lower side of the lower rack 110.

In the washing tub 100, a driving assembly 300 for rotating the spray tube 150, 160, 170 is disposed. The driving assembly 300 may be connected to the rack 110, 120 and the spray tubes 150, 160 and 170.

The plurality of spray tubes 150, 160, and 170 may include a lower spray tube 150 disposed in the lower side of the lower rack 110, an upper spray tube 160 disposed between the upper rack 120 and the lower rack 110, and a top spray tube 170 disposed in the upper side of the upper rack 120.

Each of the plurality of spray tubes 150, 160, and 170 may receive washing water from a washing pump 220 (see FIG. 3) described later. A spray pipe 130 extending from the driving unit 200 may be disposed inside the washing tub 100.

The spray pipe 130 extends from the washing pump 220, and may branch and extend toward each of the upper spray tube 160 and the top spray tube 170.

The upper spray tube 160 may be connected to the spray pipe 130, and receive washing water through the spray pipe 130. The top spray tube 170 may be connected to the spray tube 130, and receive washing water through the spray tube 130.

The lower spray tube 150 may be connected to a distribution chamber 240 (see FIG. 3) described later, and receive washing water through the distribution chamber 240.

A spray nozzle 158, 168, 178 for supplying washing water into the washing tub 100 may be formed in each of the plurality of spray tubes 150, 160, and 170.

In the lower spray tube 150, a lower spray nozzle 158 protruding toward the lower rack 110 may be formed, and a plurality of the lower spray nozzles 158 may be formed spaced apart in the length direction of the lower spray tube 150. The lower spray tube 150 may be rotatably disposed in the washing tub 100, and may be rotated by using upper and lower shafts as a rotation shaft to spray washing water toward the lower portion of the lower rack 110.

An upper spray nozzle 168 protruding toward the upper rack 120 may be formed in the upper spray tube 160, and a plurality of upper spray nozzles 168 may be formed spaced apart in the extending direction of the upper spray tube 160. The upper spray tube 160 may be rotatably connected to the washing tub 100, and may be rotated in the forward-rearward direction as a rotation shaft to spray washing water to the lower portion of the upper rack 120.

A top spray nozzle 178 protruding toward the inside of the washing tub 100 may be formed in the top spray tube 170. The top spray tube 170 may be rotatably disposed in the upper side of the washing tub 100, and may evenly spray the washing water toward the inside of the washing tub 100.

Inside the washing tub 100, a steam spray nozzle 180 for supplying steam into the washing tub 100 is disposed. The steam spray nozzle 180 may be disposed in front of the washing tub 100 adjacent to the door 20. The steam spray nozzle 180 may be disposed to face the lower rack 110.

The steam spray nozzle 180 may be connected to a heater 230 of the driving unit 200 described later, and receive steam generated by the heater 230.

The washing space 100S may be defined as a space in which a washing object, a plurality of spray tubes 150, 160, and 170, and a steam nozzle 180 are disposed, and the driving space 200S may be defined as a space for circulation of washing water formed in the lower side of the washing space 100S.

The washing space 100S may refer to an inner space of the washing tub 100, and may occupy a space equal to a first height H1.

The driving space 200S may refer to an inner space of the driving unit 200, and may occupy a space equal to a second height H2. The height of the cabinet 10 may be the sum of the first height H1 and the second height H2, and may be the sum of the heights occupied by the washing space 100S and the driving space 200S. The height H1 of the washing space 100S may be greater than the height H2 of the driving space 200S. In order to reduce the height of the cabinet 10 while maintaining the height H1 of the washing space 100S, the height H2 of the driving space 200S may be reduced.

Figure 3:
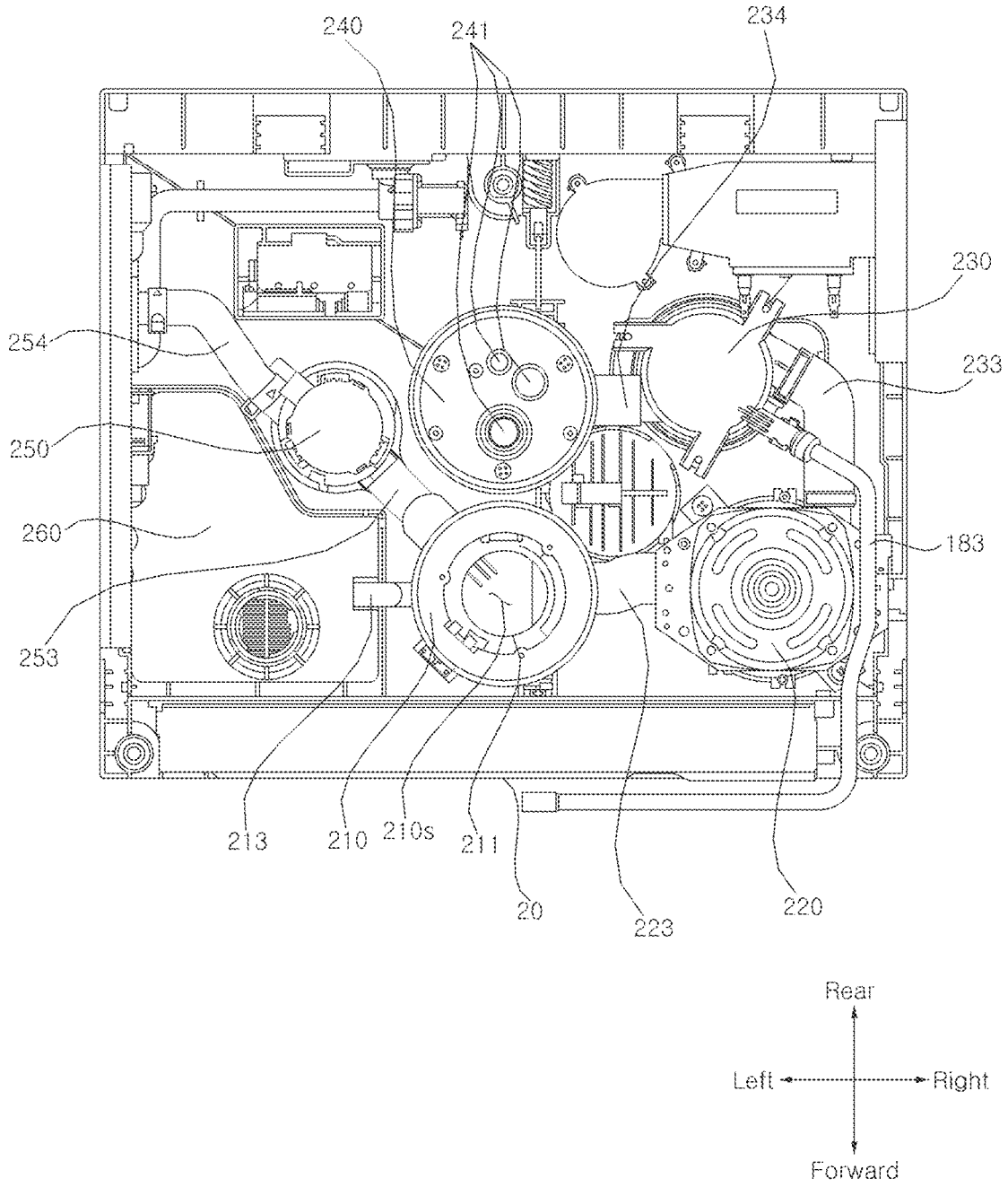
FIG. 3 is a cross-sectional view of a dishwasher according to an embodiment of the present disclosure.

Hereinafter, the internal structure of the driving unit 200 will be described with reference to FIG. 3. FIG. 3 shows the internal structure of the driving space 200S viewed from the top in a forward and downward direction.

The driving unit 200 includes a sump 210 that is disposed in the lower side of the washing tub 100 and receives washing water, a washing pump 220 that is connected to the sump 210 and extrudes washing water accommodated in the sump 210 toward the washing tub 100, and a heater 230 that is connected to the washing pump 220 and the spray nozzle 158, 168, 178, and has a space 230*s* in which washing water is heated therein.

The driving unit 200 may further include a distribution chamber 240 that is connected to the spray nozzle 158, 168, 178 and the heater 230, and is disposed to be spaced apart from the washing pump 220, a drain pump 250 disposed to be spaced apart from the sump 210, and a water softener 260 connected to the sump 210.

The sump 210 may provide a space in which washing water sprayed onto a washing object through the spray nozzle 158, 168, 178 is accommodated. In the sump 210, a sump hole 210*s* communicating with the washing tub 100 may be formed, and the sump hole 210*s* may be opened in an up-down direction.

The sump 210 includes a filter 211 that filters foreign substances contained in the washing water. The filter 211 may be disposed to surround the sump hole 210*s*. Washing water flowed into the sump 210 from the washing tub 100 may flow toward the washing pump 220 in a state in which foreign substances are removed through the filter 211.

The drain pump 250 is connected to the sump 210 to discharge washing water accommodated in the sump 210 to the outside of the cabinet 10. The sump 210 may be connected to the drain pump 250 through a drain pipe 253, and washing water and foreign substances accommodated in the sump 210 may be moved toward the drain pump 250 through the drain pipe 253.

The drain pump 250 may be connected to a washing water discharge pipe 254. The washing water discharge pipe 254 may communicate with the outside of the cabinet 10. The drain pump 250 may suck washing water and foreign substances in the sump 210 through the drain pipe 253, and extrude them out of the cabinet 10 through the washing water discharge pipe 254.

The water softener 260 may be connected to an external water source (not shown) and the sump 210 to supply washing water supplied from the external water source (not shown) to the sump 210. The water softener 260 may remove inorganic substances contained in washing water supplied from the external water source (not shown) and supply the water to the sump 210.

The sump 210 may be connected to the water softener 260 through a sump inlet pipe 213. The sump 210 may receive washing water from which inorganic substances are removed through the sump inlet pipe 213.

The washing pump 220 may be connected to the sump 210 through a pump inlet pipe 223. The washing pump 220 may be connected to the heater 230 through a heater inlet pipe 233.

The washing pump 220 may suck the washing water accommodated in the sump 210 through the pump inlet pipe 223, and extrude it to the heater 230 through the heater inlet pipe 233.

The heater 230 may be connected to the washing pump 220 through the heater inlet pipe 233, and may be connected to the distribution chamber 240 through a heater discharge pipe 234.

The heater 230 may heat the washing water flowed from the washing pump 220 to form a hot washing water. The hot washing water may flow into the distribution chamber 240 through the heater discharge pipe 234.

The heater 230 may heat the washing water flowed from the washing pump 220 to make it into a steam state. The washing water in the steam state may flow into the steam nozzle 180 through the steam nozzle inlet pipe 183. The washing water in a steam state introduced into the steam nozzle 180 may be sprayed toward a washing object accommodated inside the washing tub 100.

The distribution chamber 240 may be connected to the heater 230 through the heater discharge pipe 234. The distribution chamber 240 may receive liquid washing water heated by the heater 230.

The distribution chamber 240 may be provided with a plurality of distribution holes 241 that are disposed in the up and down sides to be opened. The distribution chamber 240 may supply washing water to the spray tube 150, 160, 170 through the plurality of distribution holes 241. Any one of the plurality of distribution holes 241 may communicate with the lower spray tube 150.

Another one of the plurality of distribution holes 241 may communicate with the upper spray tube 160 or the top spray tube 170 through the spray pipe 130.

The washing water flowed into the distribution chamber 240 may flow to the lower spray tube 150 through any one of the distribution holes 241, and may flow into the upper spray tube 160 or the top spray tube 170 through another distribution hole 241.

The lower spray tube 150 may be directly inserted into the distribution hole 241 and connected to the distribution chamber 240, or may be connected to the distribution chamber 240 through a separate pipe inserted into the distribution hole 241.

The upper spray tube 160 and the top spray tube 170 may be connected to the distribution chamber 240 through the spray pipe 130 inserted into the distribution hole 241.

The distribution chamber 240 may selectively supply the flowed washing water to the lower spray tube 150, the upper spray tube 160, and the top spray tube 170. The distribution chamber 240 may supply washing water only through one of the plurality of distribution holes 241, or through multiple distribution holes among the plurality of distribution holes 241.

The sump 210, the washing pump 220, the heater 230, the distribution chamber 240, the drain pump 250, and the water softener 260 may be horizontally spaced apart from each other.

The sump 210, the washing pump 220, the heater 230, the distribution chamber 240, the drain pump 250, and the water softener 260 may be disposed such that at least a part of them is located at the same height.

A direction for explaining the positional relationship of each structure within the driving unit 200 is defined. The direction in which the door 20 is disposed is define as a forward direction, the direction opposite to the door 20 is define as a rearward direction, the left side when the door 20 is viewed from the front is define as a left direction, and the right side when the door 20 is viewed from the front is define as a right direction. The forward and rearward directions and the left-right direction defined here may be identically applied to content described later.

The water softener 260 may be disposed in the left side of the driving unit 200. The sump inlet pipe 213 extends in the left-right direction to connect the water softener 260 and the sump 210. The sump 210 may be disposed in the right side of the water softener 260.

The drain pump 250 may be disposed in the left side of the sump 210. The drain pump 250 may be disposed in the rear side than the sump 210. The drain pipe 253 may extend in the left-rearward direction from the sump 210 and connect the sump 210 and the drain pump 250.

The washing water discharge pipe 254 may extend in the left-rearward direction from the drain pump 250, and may be connected to the cabinet 10.

The pump inlet pipe 223 may extend in the left-right direction to connect the sump 210 and the washing pump 220. The pump inlet pipe 223 may extend in a direction intersecting the drain pipe 213. The pump inlet pipe 223 may extend in a direction parallel to the sump inlet pipe 213.

The heater inlet pipe 233 may extend in the forward-rearward direction to connect the washing pump 220 and the heater 230. The heater inlet pipe 233 may extend in a direction intersecting the pump inlet pipe 223.

The heater discharge pipe 234 may extend in the left-right direction to connect the heater 230 and the distribution chamber 240. The heater discharge pipe 234 may extend in a direction intersecting the heater inlet pipe 233. The heater discharge pipe 234 may extend in a direction parallel to the pump inlet pipe 223. The heater discharge pipe 234 and the pump inlet pipe 223 may be disposed to face each other in the forward-rearward direction.

The sump 210 may be disposed to face the washing pump 220 in the left-right direction. The sump 210 may be disposed to face the distribution chamber 240 in the forward-rearward direction. The washing pump 220 may be disposed in the right side of the sump 210. The distribution chamber 240 may be disposed in a rear side than the sump 210.

The washing pump 220 may be disposed to face the heater 230 in the forward-rearward direction. The heater 230 may be disposed in a rear side than the washing pump 220. The distribution chamber 240 may be disposed to face the heater 230 in the left-right direction. The distribution chamber 240 may be disposed to face the drain pump 250 in the left-right direction. The heater 230 may be disposed in the right side of the distribution chamber 240. The drain pump 250 may be disposed in the left side than the distribution chamber 240.

Due to the above described structure, the passage structure connecting the drain pipe 253, the pump inlet pipe 223, the heater inlet pipe 233, and the heater discharge pipe 234 may be configured in a 'U' shape.

Accordingly, the drain pump 250, the sump 210, the washing pump 220, the heater 230, and the distribution chamber 240 can all be disposed in a dense space within the driving unit 200, thereby increasing space utilization.

Figure 4:
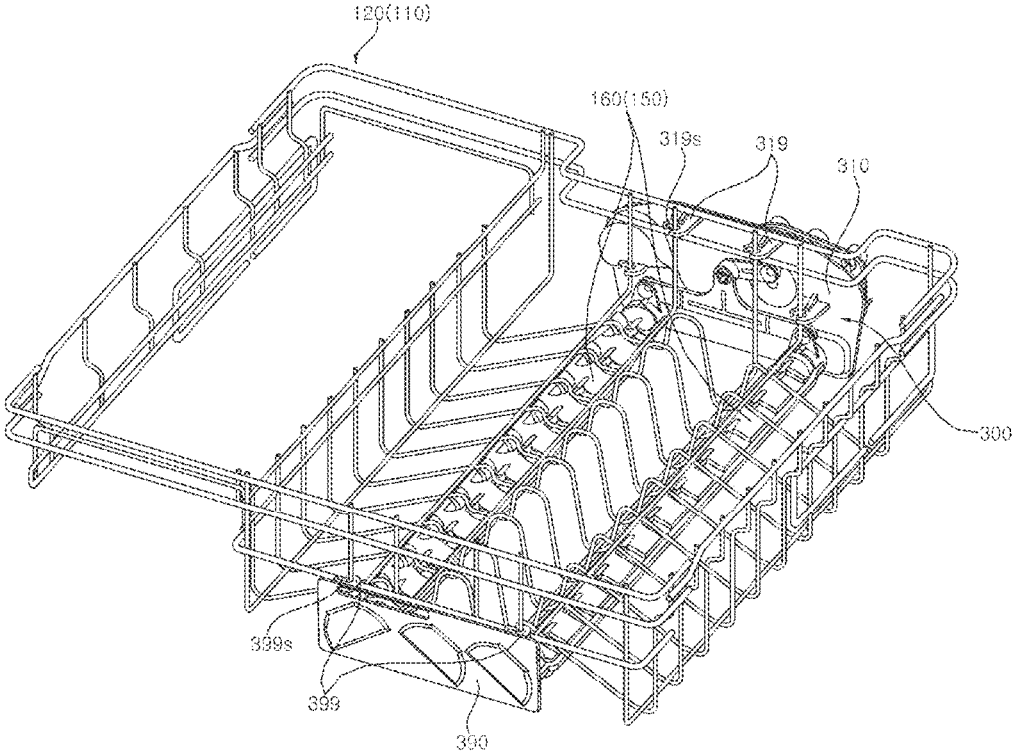
FIG. 4 is a perspective view of a rack and a spray tube according to an embodiment of the present disclosure.
Figure 5:
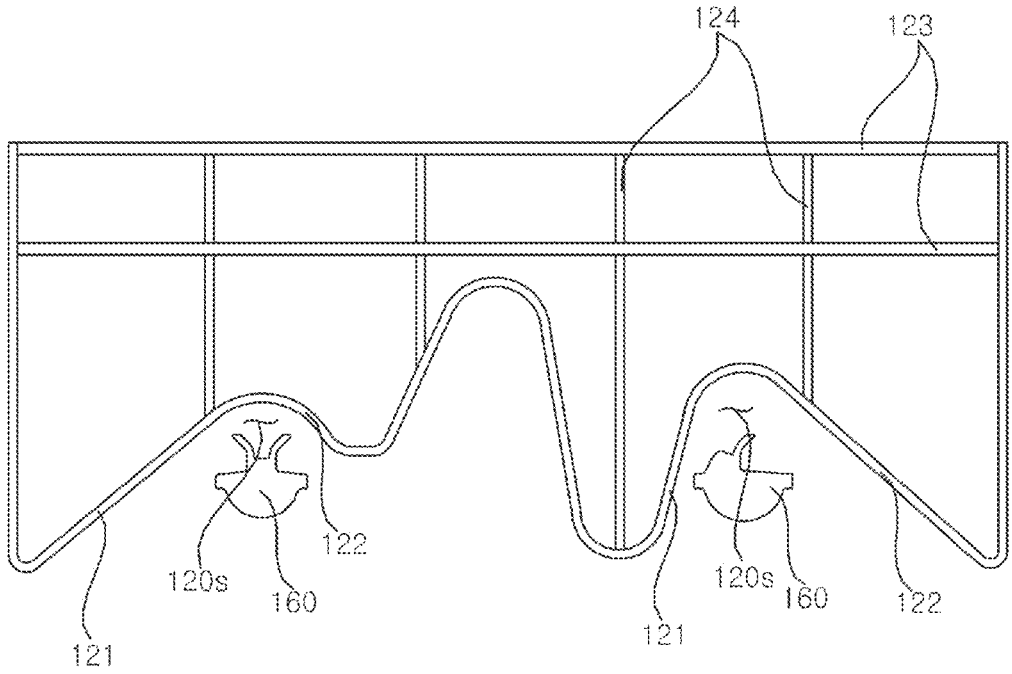
FIG. 5 is a front view of a rack and a spray tube according to an embodiment of the present disclosure.

Hereinafter, the disposition relationship between the rack 110, 120 and the spray tube 150, 160 will be described with reference to FIGS. 4 and 5. FIG. 4 is a perspective view of a state in which the rack 110, 120 and the spray tube 150, 160 are disposed, and FIG. 5 conceptually illustrates a form of a front view of a portion of a state in which the rack 110, 120 and the spray tube 150, 160 are disposed.

The spray tube 150, 160 may be disposed in the lower side of the rack 110, 120. The spray tube 150, 160 may be disposed in a spray space 120*s* formed in the lower side of the rack 110, 120.

The lower spray tube 150 may be disposed in the lower side of the lower rack 110, and the upper spray tube 160 may be disposed in the lower side of the upper rack 120. The disposition relationship between the lower spray tube 150 and the lower rack 110 may be the same as the disposition relationship between the upper spray tube 160 and the upper rack 120. Hereinafter, for convenience of explanation, the upper spray tube 160 and the upper rack 120 will be described as an example.

The rack 120 may include a first wire 121 extending obliquely upward, and a second wire 122 that extends obliquely upward to intersect the first wire 121 and forms a spray space 120*s* between the first wire 121 and the second wire 122.

The first wire 121 and the second wire 122 may be formed in a separate type so as to be detachable from each other, or may be formed as one body. A washing object may be disposed above the first wire 121 and the second wire 122, and supported by the first wire 121 and the second wire 122.

A plurality of first wires 121 and a plurality of second wires 122 may be formed so as to be spaced apart along the length direction of the rack 120, and a plurality of spray spaces 120*s* may be formed between each of the first wire 121 and the second wire 122. The spray tube 160 may be disposed in each of the plurality of spray spaces 120*s*.

The rack 120 may include a first rack frame 123 extending in the length direction of the rack 120, and a second rack frame 124 extending in the up-down direction to intersect the first rack frame 123.

The first rack frame 123 and the second rack frame 124 may be disposed above the first wire 121 and the second wire 122, and may form a space in which a washing object is accommodated.

The driving assembly 300 connected to the spray nozzle 160 may be connected to the rack 120. The driving assembly 300 may be rotatably connected to the spray nozzle 160, and may be supported by the rack 120.

The driving assembly 300 may include a blocking block 310 disposed in one side of the rack 120, and a supporter 390 disposed in the other side of the rack 120 spaced apart from the blocking block 310. The spray nozzle 160 may be disposed between the blocking block 310 and the supporter 390, and may be rotatably connected to each of the blocking block 310 and the supporter 390.

The blocking block 310 may protrude toward the rack 120, and have a fastening boss 319 connected to the rack 120. The blocking block 310 may be connected to a first rack frame 123 or a second rack frame 124 through the fastening boss 319. The fastening boss 319 may have a fastening boss groove 319*s* through which the first rack frame 123 or the second rack frame 124 passes. The blocking block 310 may be fixed to the rack 120 by forcibly fitting the first rack frame 123 or the second rack frame 124 into the fastening boss groove 319*s*.

The supporter 390 may protrude toward the rack 120, and may have a fastening boss 399 connected to the rack 120. The supporter 390 may be connected to the first rack frame 123 or the second rack frame 124 through the fastening boss 399. The fastening boss 399 may have a fastening boss groove 399*s* through which the first rack frame 123 or the second rack frame 124 passes. The supporter 390 may be fixed to the rack 120 by forcibly fitting the first rack frame 123 or the second rack frame 124 into the fastening boss groove 399*s*.

When it is necessary to distinguish the fastening bosses 319 and 399, the fastening boss 319 formed in the blocking block 310 is referred to as a first fastening boss 319, and the fastening boss 399 formed in the supporter 390 is referred to as a second fastening boss 399.

When it is necessary to distinguish the fastening boss grooves 319*s* and 399*s*, the fastening boss groove 319*s* formed in the first fastening boss 319 is referred to as a first fastening boss groove 319*s*, and the fastening boss groove 399*s* formed in the second fastening boss 399 is referred to as a second fastening boss groove 399*s*.

Figure 6:
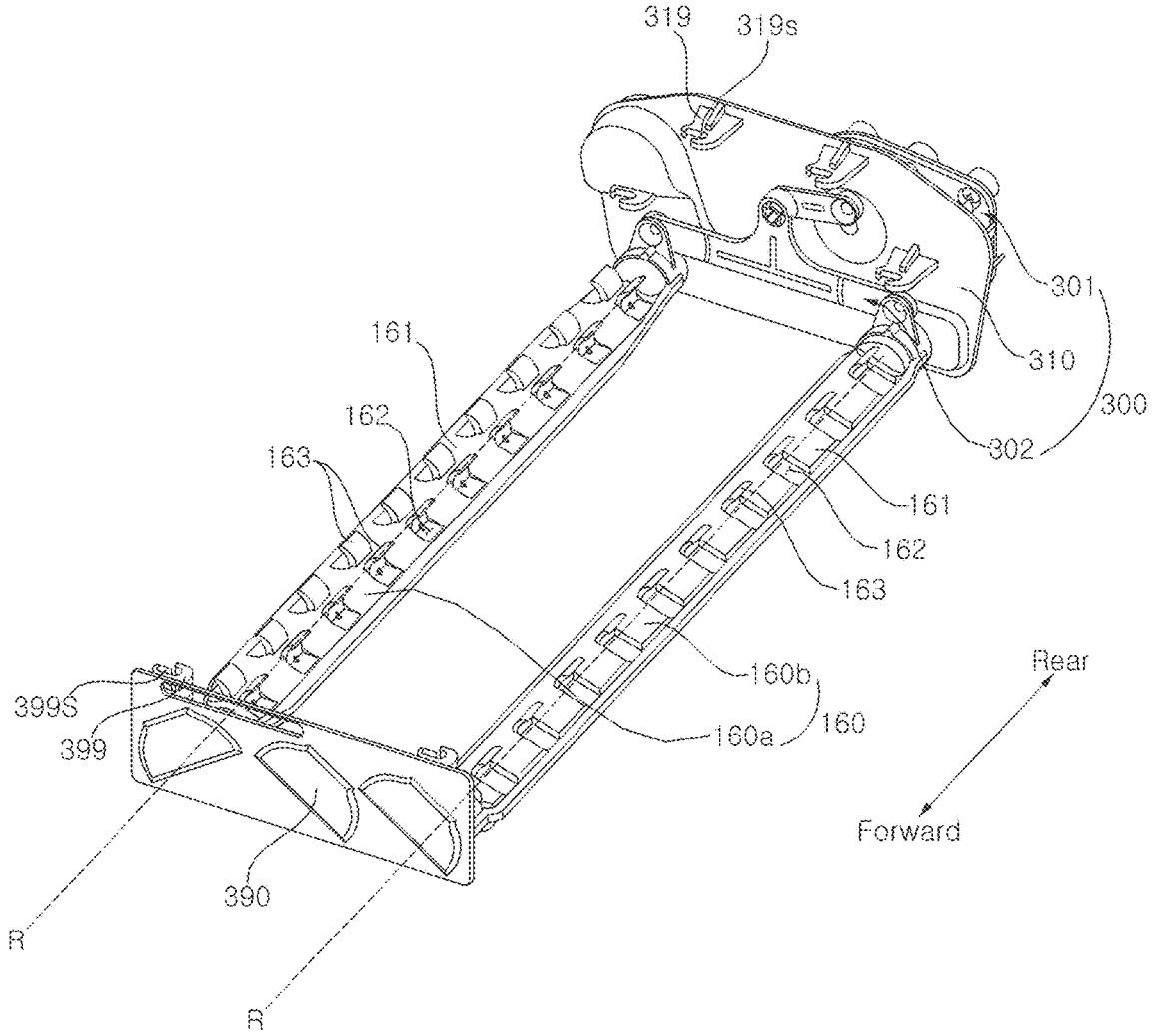
FIG. 6 is a perspective view of a spray tube and a drive assembly according to an embodiment of the present disclosure.

Hereinafter, referring to FIG. 6, the connection relationship between the driving assembly 300 and the spray tube 160 will be described. FIG. 6 shows the driving assembly 300 and the spray tube 160 that are only separated.

The spray tube 160 extends in the width direction of the rack 120, and has a rotation shaft R extending in the width direction of the rack 120. The spray tube 160 may extend in the forward-rearward direction, and may have a rotation shaft R extending in the forward-rearward direction.

The supporter 390 may be disposed in front of the spray tube 160, and the blocking block 310 may be disposed in the rear of the spray tube 160. The door 20 may be disposed in front of the supporter 390, and the rear surface of the washing tub 100 may be disposed in the rear of the blocking block 310.

The spray tube 160 may be disposed between the supporter 390 and the blocking block 310, and may be rotatably connected to the supporter 390 and the blocking block 310.

The driving assembly 300 includes a power applying device 301 that generates power so as to move the spray tube 160, and a driving module 302 connected to the power applying device 301 and the spray tube 160, respectively.

The power applying device 301 may be disposed in a rear of the blocking block 310, and the driving module 302 may be disposed in front of the blocking block 310.

The spray tube 160 may be rotatably connected to the driving module 302, and may be reciprocated by the driving module 302 within a certain angular range. The spray tube 160 may be rotatably connected to the supporter 390, and the other side opposite to the driving module 302 may be supported by the supporter 390.

A plurality of spray tubes 160 may be disposed spaced apart in the length direction of the rack 120, and each of the plurality of spray tubes 160*a* and 160*b* may be rotatably connected to the driving module 302. If it is necessary to distinguish the plurality of spray tubes 160*a* and 160*b*, they may be classified into a first spray tube 160*a* and a second spray tube 160*b*.

The spray tube 160 may include a tube body 161 extending in a forward and rearward direction, a nozzle hole 162 formed in the tube body 161 by being opened, and a spray wall 163 extending upward from the nozzle hole 162.

A plurality of nozzle holes 162 may be formed to be spaced apart along the length direction of the tube body 161, and a plurality of spray walls 163 may be formed to correspond to each of the plurality of nozzle holes 162.

The washing water extruded from the washing pump 220 flows into the blocking block 310 through the spray pipe 130. The washing water flowing into the blocking block 310 flows into the spray tube 160 and flows forward along the spray tube 160. The washing water flowing forward along the spray tube 160 is sprayed onto the washing object seated in the rack 120 through the nozzle hole 162. The spray wall 163 may guide a flow direction of the washing water sprayed through the nozzle hole 162.

Figure 7:
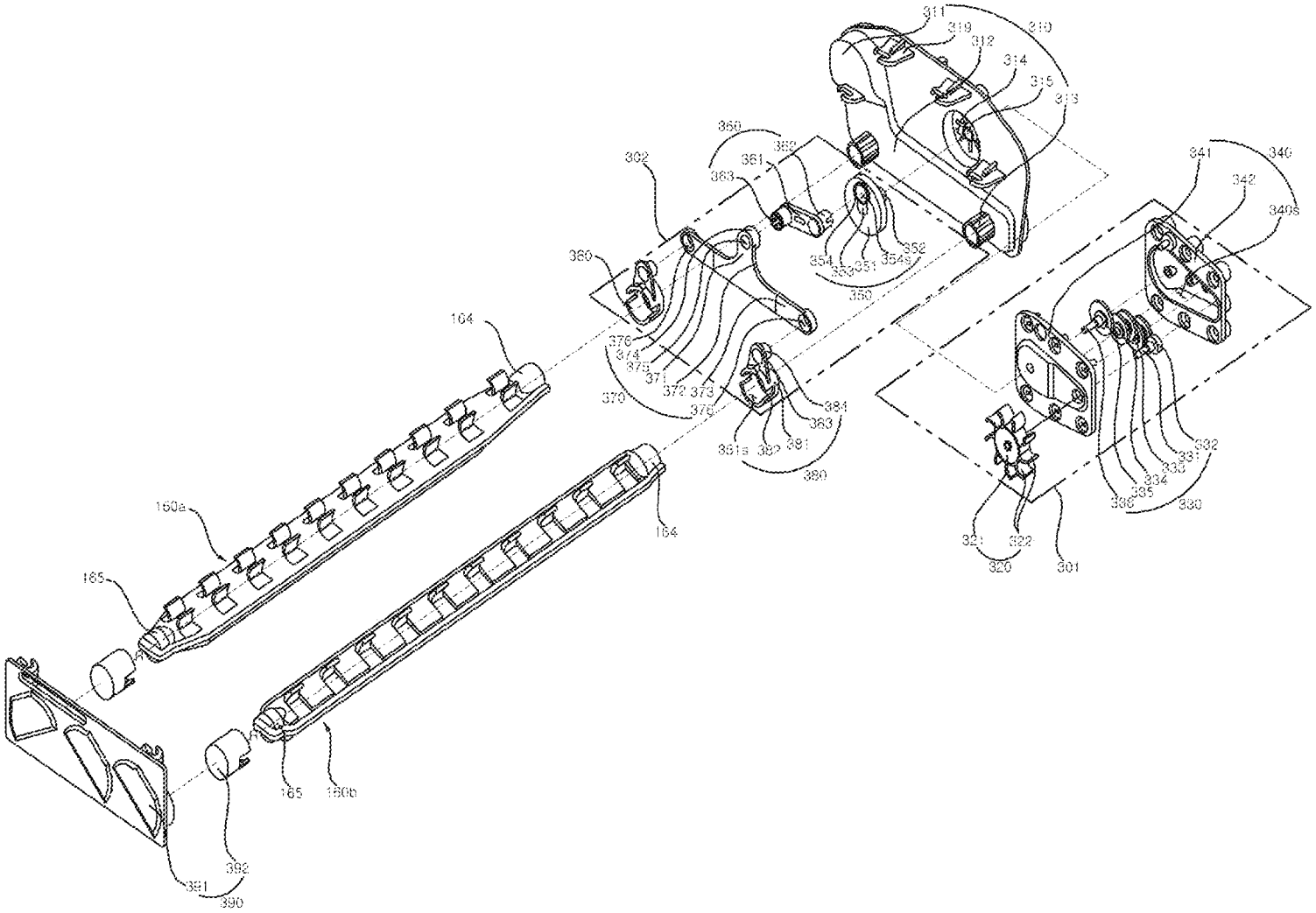
FIG. 7 is an exploded perspective view of a spray tube and a drive assembly according to an embodiment of the present disclosure.

Hereinafter, a detailed structure of the driving assembly 300 will be described with reference to FIG. 7. FIG. 7 shows a form in which the driving assembly 300 is separated from the spray tube 160 and disassembled.

The power applying device 301 may include an impeller 320 having a plurality of blades 322 spaced apart from each other in the circumferential direction, a gear train 330 connected to the impeller 320, and a gear cover 340 disposed to surround the gear train 330.

The impeller 320 may include a disk-shaped impeller body 321, and a plurality of blades 322 extending radially outward from the impeller body 321. Each of the plurality of blades 322 may be circumferentially spaced apart from each other.

The gear train 330 may include an impeller shaft 331 connected to the impeller 320, a first driving gear 332 connected to the impeller shaft 331, a second driving gear 333 engaged with the first driving gear 332, a third driving gear 334 engaged with the second driving gear 333, a driven gear 335 engaged with the third driving gear 334, and a power shaft 336 connecting the driven gear 335 and the driving module 302.

The first driving gear 332, the second driving gear 333, and the third driving gear 334 may have different diameters, and may have different gear ratios. The first driving gear 332, the second driving gear 333, and the third driving gear 334 may be referred to as "driving gear" that transmit rotational force generated by the impeller 320 to the driven gear 335.

The driving gear may reduce the rotational rpm of the impeller shaft 331 and transmit it to the power shaft 336. The driving gear may be composed of three gears 332, 333, and 334, but is not limited thereto, and it is sufficient if there are provided a plurality of gears.

The driven gear 335 may rotate the power shaft 336 by receiving rotational force of the impeller shaft 331 from the driving gear. The power shaft 336 may be connected to the driving module 302 to transmit rotational force of the impeller shaft 331 to the driving module 302. The power shaft 336 may be connected to a rotation body 350 described later to rotate the rotation body 350.

The gear cover 340 may include a first gear cover 341 disposed in front of the gear train 330, and a second gear cover 342 disposed in a rear of the gear train 330. The first gear cover 341 and the second gear cover 342 may be disposed to be detachable from each other. The first gear cover 341 and the second gear cover 342 may be connected to each other to form a gear space 340*s* in which the gear train 330 is disposed.

The driving module 302 may include a rotation body 350 rotatably connected to the power applying device 301, a first link 360 which is connected to the rotation body 350 and moves along the circumferential direction of the rotation body 350, a second link 370 connected to the first link 360 to move relatively, and a pendulum body 380 that extends from one end portion connected to the spray tube 160 in a direction intersecting the spray tube 160, and has the other end portion, which spaced apart from the one end portion, that performs pendulum motion around the rotation shaft R.

The driving module 302 may include a conversion link 360, 370 connected to the rotation body 350 and the pendulum body 380 so that the rotational motion of the rotation body 350 is converted into the pendulum motion of the pendulum body 380.

The conversion link 360, 370 may include a first link 360 respectively connected to the rotation body 350 and a second link 370, and the second link 370 connected to the first link 360 and the pendulum body 380 to move relatively.

The rotation body 350 may include a rotating plate 351 rotatably disposed on the blocking block 310, a shaft insertion boss 352 which is formed to protrude in a rearward direction from the rotating plate 351 and into which the power shaft 336 is inserted, a shaft insertion groove 353 opened in the forward-rearward direction of the rotating plate 351, a link insertion boss 354 formed to protrude in a forward direction at a position spaced radially outward from the shaft insertion groove 353, and a third joint groove 354*s* opened in the forward-rearward direction in the inside of the link insertion boss 354.

The power shaft 336 may be connected to the rotation body 350 through a shaft insertion groove 353 formed inside the shaft insertion boss 352. The rotating plate 351 may have a disk shape, and the shaft insertion groove 353 may be formed in the center of the rotating plate 351.

The first link 360 may include a link body 361 forming an outer shape, a third joint 362 that protrudes in a rearward direction from the link body 361 and is connected to the rotation body 350, and a first joint 363 that protrudes in a forward direction from the link body 361 and is connected to the second link 370. The link body 361, the first joint 363, and the third joint 362 may be formed as one body.

The third joint 362 may be inserted into the third joint groove 354*s* formed at a position radially spaced from the center of the rotation body 350. The third joint 362 may be rotated eccentrically with respect to the center of rotation of the rotation body 350.

The third joint 362 may be inserted into the third joint groove 354*s* so as to be relatively rotatable with respect to the rotation body 350. When the rotation body 350 is rotated, the third joint 362 may rotate independently of the rotation of the rotation body 350 while being located in the third joint groove 354*s*. Thus, when the rotation body 350 is rotated, the angle formed by a straight line connecting the power shaft 336 and the third joint 362 and an extension direction of the link body 361 may be continuously changed. The link body 361 may extend radially outward with respect to the rotation body 350. The third joint 362 may be moved along the circumferential direction of the rotation body 350, and the link body 361 in which the third joint 362 is formed is also moved along the circumferential direction of the rotation body 350.

The second link 370 may include a first frame 371 that extends in the up-down direction and is connected to the first link 360, a second frame 373 that extends in a direction intersecting the first frame 371 and is connected to the pendulum body 380, a rounding portion 372 connecting the first frame 371 and the second frame 373, a link head 374 forming a first joint groove 375 into which the first joint 363 is inserted, and a second joint groove 376 formed in both sides of the second frame 373.

The first frame 371 and the second frame 373 may be formed as one body, and a portion where the first frame 371 and the second frame 373 are connected may form a curved rounding portion 372.

The link head 374 may be formed in an upper end of the first frame 371 and may form the first joint groove 375 opened in the forward-rearward direction.

The second joint groove 376 may be formed in both ends of the second frame 373 by being opened in the forward-rearward direction. The plurality of pendulum bodies 380 connected to the plurality of spray tubes 160 respectively may be connected to second joint grooves 376 respectively formed in both ends of the second frame 373.

The first joint 363 may be inserted into the first joint groove 375 so as to be relatively rotatable with respect to the second link 370. When the rotation body 350 is rotated, the first joint 363 may rotate independently of the rotation of the second link 370 while being located in the first joint groove 375. Thus, when the rotation body 350 is rotated, the angle between the extension direction of the first frame 371 and the extension direction of the link body 361 may be continuously changed.

The pendulum body 380 may include a holder 381 extending to surround a pendulum body hole 381*s* into which the spray tube 160 is inserted, a pendulum link 383 extending from the holder 381 in a direction intersecting the spray tube 160, and a second joint 384 formed to protrude in a rearward direction from the pendulum link 383.

The holder 381 may have a cylindrical shape, and a cylindrical pendulum body hole 381*s* may be formed therein. A connector 164 described later may be inserted into the pendulum body hole 381*s* to connect the spray tube 160 and the pendulum body 380.

The holder 381 may have a holder groove 382 into which a connector protrusion 164*a* described later is inserted. The holder groove 382 may be formed to be recessed from the front side of the holder 381 to the rear side and communicate with the pendulum body hole 381*s*.

The pendulum link 383 may extend upward from the holder 381, and the second joint 384 may be formed in the upper end of the pendulum link 383.

The second joint 384 may be inserted into the second joint groove 376 so as to be relatively rotatable with respect to the second link 370. When the rotation body 350 is rotated, the second joint 384 may be moved independently of the movement of the second link 370 while being located in the second joint groove 376. Accordingly, when the rotation body 350 is rotated, the angle between the extension direction of the second frame 373 and the extension direction of the pendulum link 383 may be continuously changed.

The second joint 384 may be connected to the second link 370 at an upper side than the rotation shaft R of the spray tube 160, and pendulum motion may be performed around the rotation shaft R. The pendulum motion may be differently expressed as reciprocating rotation around the rotation shaft R, or may be differently expressed as reciprocating movement. The second joint 384 may be rotated while periodically changing a moving direction around the rotation shaft R.

The blocking block 310 may include a washing water inlet end 311 into which washing water extruded from the washing pump 220 flows, a washing water passage 312 through which the washing water flowed through the washing water inlet end 311 flows, a washing water distribution port 313 protruding from the washing water passage 312 toward the spray tube 160, a groove 314 formed to be recessed in a rearward direction, and a power shaft boss 315 formed to protrude in a forward direction in the groove 314.

The washing water inlet end 311 may be connected to the spray pipe 130 and may receive washing water from the spray pipe 130.

The washing water passage 312 may extend from the washing water inlet end 311, and communicate with the washing water inlet end 311 so that the washing water may flow therein.

The washing water distribution port 313 may protrude in a forward direction from the washing water passage 312, and may be inserted into the connector 164 by penetrating the pendulum body hole 381*s*. The spray tube 160 may receive washing water through the washing water distribution port 313.

The rotation body 350 may be disposed inside the groove 314, and the power shaft 336 may penetrate the power shaft boss 315 and the shaft insertion groove 353.

The spray tube 160 may include a first connector 164 that forms one end of the spray tube 160 and is connected to the pendulum body 380, and a second connector 165 that forms the other end of the spray tube 160 and is connected to the supporter 390. The first connector 164 and the second connector 165 may be referred to as "connector" supporting the spray tube 160.

The first connector 164 may protrude from the spray tube 160 toward the pendulum body 380 and may be inserted into and fixed to the pendulum body hole 381*s*.

The first connector 164 may have a connector protrusion 164*a* protruding outward in a radial direction, and the connector protrusion 164*a* may be inserted into the holder groove 382.

The supporter 390 may include a support block 391 connected to the rack 110, 120, and a bearing 392 that is fixedly disposed in the support block 391 and rotatably connected to the spray tube 160.

The support block 391 may have a rectangular plate shape, and the fastening boss 399 may protrude from the support block 391.

The bearing 392 may be rotatably connected to the connector 165 and may use a ball bearing. The bearing 392 may connect the spray tube 160 and the support block 391 and support rotation of the spray tube 160.

Figure 8:
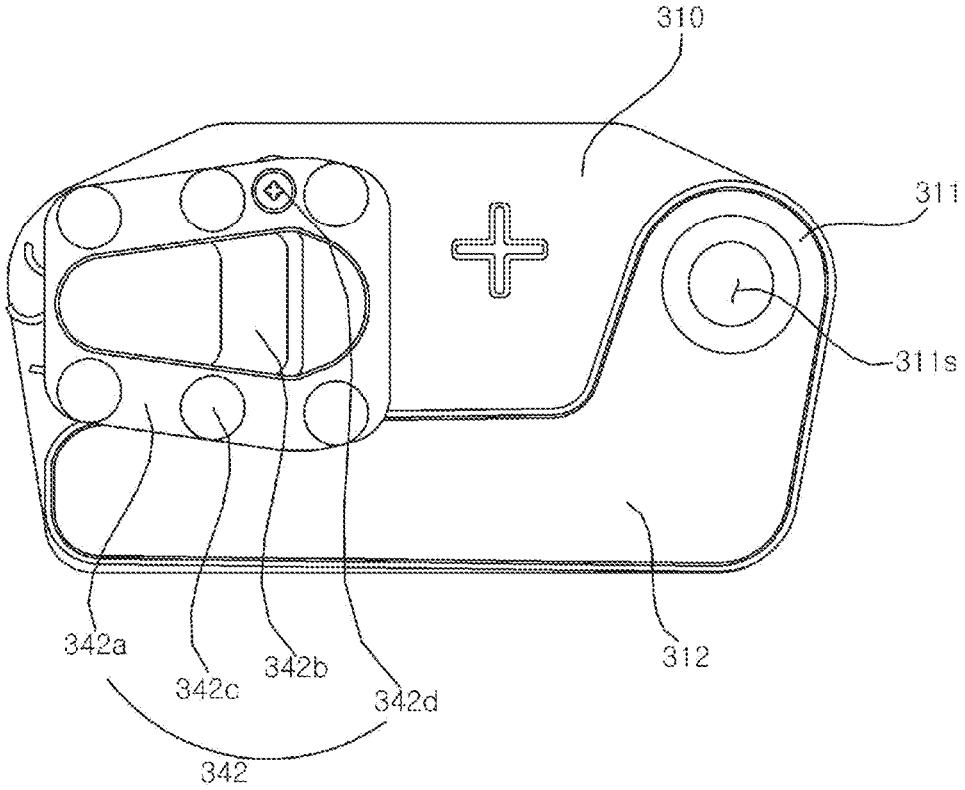
FIG. 8 is a side view of a drive assembly according to an embodiment of the present disclosure.
Figure 9:
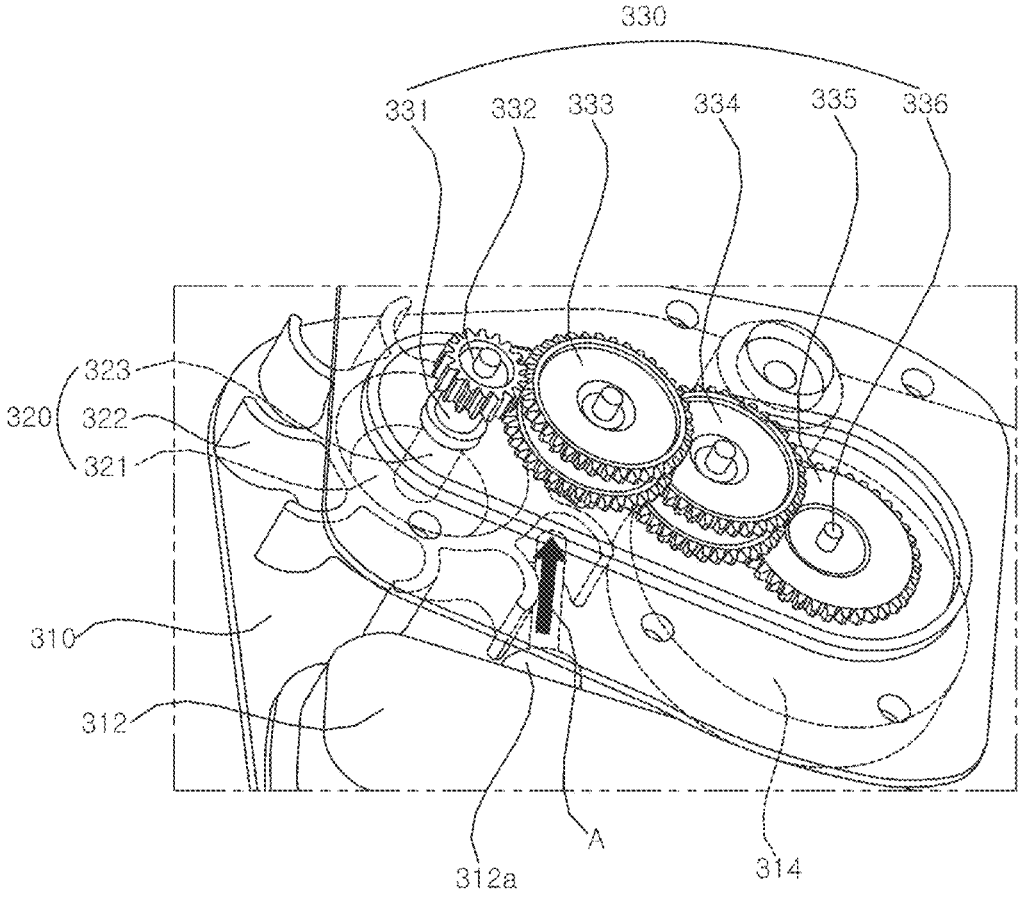
FIG. 9 is an internal perspective view of a power applying device according to an embodiment of the present disclosure.

Hereinafter, the driving principle of the power applying device 301 will be described with reference to FIGS. 8 and 9. FIG. 8 shows the driving assembly 300 viewed from the rear toward the front, and FIG. 9 shows the inside of the gear cover 340 through perspective.

The washing water inlet end 311 may be formed to protrude in a rearward direction from the blocking block 310, and may extend downward. The washing water inlet end 311 may form a washing water inlet 311*s* that is opened in the forward and rearward direction and is connected to the spray pipe 130.

The washing water passage 312 may extend from the lower portion of the washing water inlet end 311 in the left-right direction. The washing water passage 312 may be formed to protrude in a rearward direction from the blocking block 310, and a space in which washing water flows may be formed therein.

The second gear cover 342 may include a cover plate 342*a* connected to the first gear cover 341, a gear accommodating portion 342*b* protruding in a rearward direction from the cover plate 342*a*, a cover boss 342*c* protruding in a rearward direction from the cover plate 342*a*, and a cover fastening member 342*d* connecting the first gear cover 341 and the second gear cover 342.

The gear train 330 may be disposed within the gear accommodating portion 342*b*. The first gear cover 341 and the second gear cover 342 may be connected through a certain fastening member inserted into the cover boss 342*c*.

The washing water passage 312 may form a branch port 312*a* protruding upward. Some of the washing water flowing in the washing water passage 312 may flow to a tube space 160*s* (see FIG. 10) formed in the spray tube 160 through the washing water distribution port 313, and the rest may be supplied toward the impeller 320 through the branch port 312*a*.

The washing water ejected through the branch port 312*a* may move along a collision direction A and strike the blade 322 of the impeller 320.

The impeller 320 may be rotated by a collision aberration method, and may be rotated when the washing water moves along the collision direction A and strikes the blade 322. When the impeller 320 is rotated, the impeller shaft 331 inserted into the impeller boss 323 protruding in a rearward direction from the impeller body 321 is rotated.

When the impeller shaft 331 is rotated, the first driving gear 332 connected to the impeller shaft 331 is rotated, and the second driving gear 333, the third driving gear 334, and the driven gear 335 engaged directly or indirectly with the first driving gear 332 are rotated sequentially.

The power shaft 336 is rotated together with the driven gear 335 to rotate the rotation body 350 disposed in the groove 314 to apply power to the driving module 302.

In this embodiment, rotation of the impeller 320 by washing water is exemplified as a power apply method, but the power apply method is not limited thereto and may be a method of directly rotating the power shaft 336 through a motor (not shown).

Figure 10:
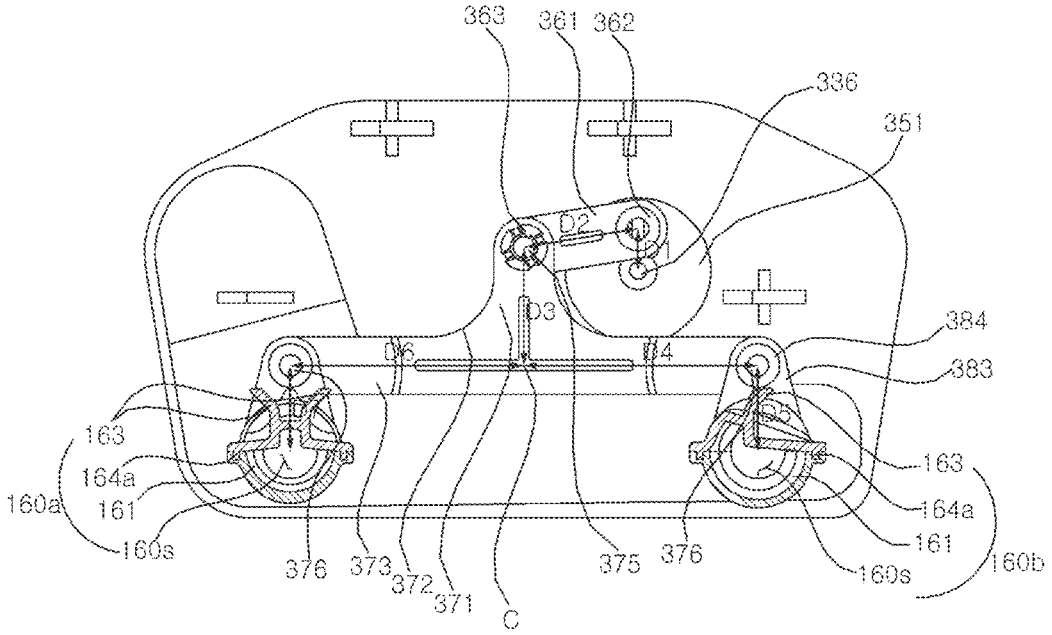
FIG. 10 is a front view of a driving module according to an embodiment of the present disclosure.

Hereinafter, a detailed structure of the driving module 302 will be described with reference to FIG. 10. FIG. 10 shows the driving module 302 viewed from the front toward the rear.

The first frame 371 may extend in the up-down direction, and the second frame 373 may extend in a direction intersecting the first frame 371.

The second link 370 may be formed to be bent at least once between the first joint 363 and the second joint 384. The center line of the first frame 371 and the center line of the second frame 373 may form an intersection point C. The first frame 371 may extend upward from the intersection point C, and the second frame 373 may extend in the left-right direction from the intersection point C. Accordingly, the overall outer shape of the second link 370 may be an inverted 'T' shape.

The second link 370 may be respectively connected to the plurality of pendulum bodies 380 in both ends of the second frame 373.

The power, which is applied through the rotation body 350 and sequentially transmitted to the first link 360 and the second link 370, may be transmitted to each of the plurality of pendulum bodies 380 connected to the second link 370.

The third joint 362 may be spaced apart from the power shaft 336 by a first distance D1. The first joint 363 may be spaced apart from the third joint 362 by a second distance D2. The intersection point C may be spaced apart from the first joint 363 by a third distance D3. The second joint 384 connected to the second spray tube 160*b* may be spaced apart from the intersection C by a fourth distance D4. The rotation shaft R of the second spray tube 160*b* may be spaced apart from the second joint 384 by a fifth distance D5. The second joint 384 connected to the first spray tube 160*a* may be spaced apart from the intersection C by a sixth distance D6. The rotation shaft R of the first spray tube 160*a* may be spaced apart from the second joint 384 by a seventh distance D7.

The driving module 302 may be moved by a four-bar link mechanism composed of the rotation body 350, the first link 360, the second link 370, the pendulum body 380, and the spray tube 160. Due to the four-bar link mechanism, the rotational motion of the rotation body 350 caused by the rotation of the power shaft 336 is converted into pendulum motion through the conversion link 360, 370 and transmitted to the pendulum body 380.

The spray tube 160 that is coupled to the pendulum body 380 and rotated as one body may be reciprocally rotated around the rotation shaft R within a certain angle range.

More specifically, the rotational motion transmitted through the power shaft 336 may be converted into a pendulum motion and transmitted to the spray tube 160, through eccentric disposition of the third joint 362 with respect to the power shaft 336, a relative rotation between the third joint 362 and the first joint 363, and the bent structure of the second link 370 and the separation structure between the second joint 384 and the rotation shaft R.

The driving module 302 may adjust the rotation radius of each of the plurality of spray tubes 160 by changing the first distance D1, the second distance D2, the third distance D3, the fourth distance D4, the fifth distance D5, the sixth distance D6, and the seventh distance D7.

The length of the first frame 371 may be shorter than the length of the second frame 373. The third distance D3 may be smaller than the fourth distance D4 and the sixth distance D6.

Figure 11:
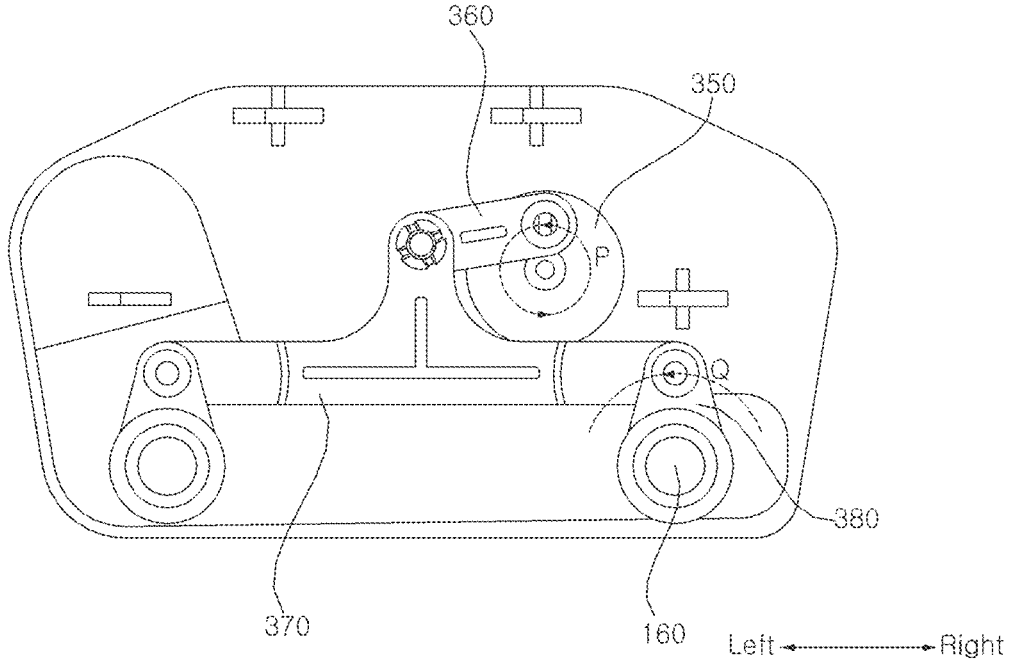
FIGS. 11, 12, and 13 are views illustrating a motion of a driving module according to an embodiment of the present disclosure.
Figure 12:
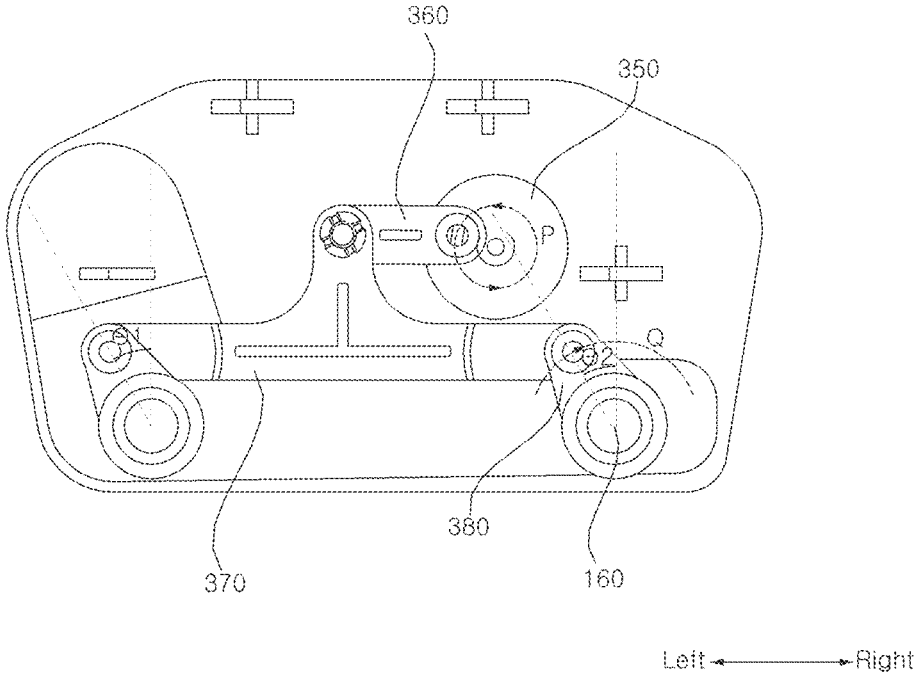
Figure 13:
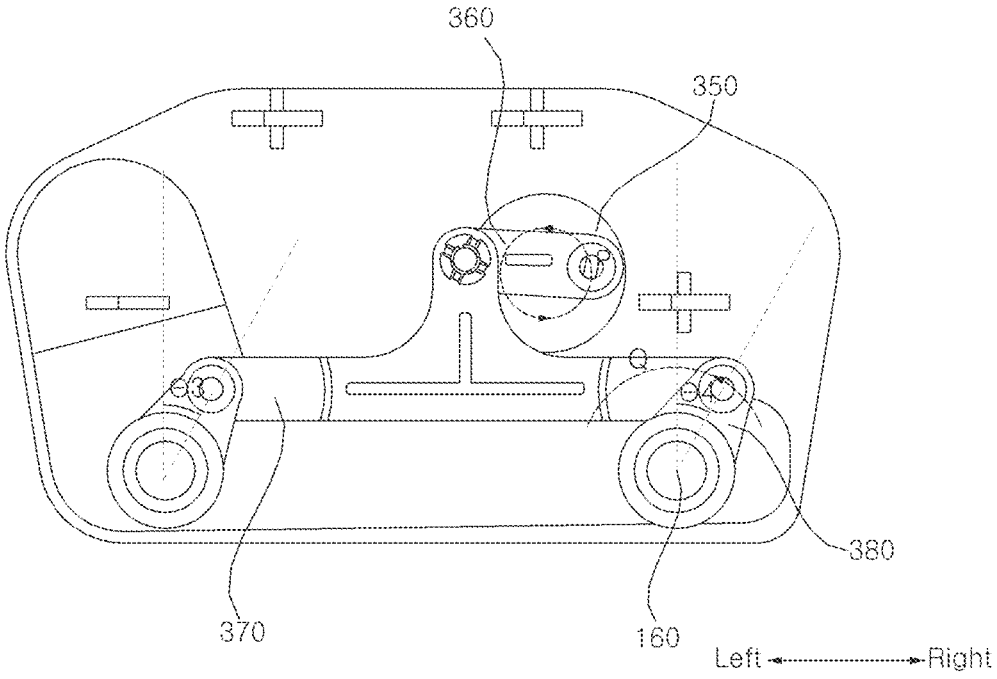

Hereinafter, the operation of the driving module 302 will be described with reference to FIGS. 11, 12, and 13. FIG. 11 shows the state of the driving module 302 when the pendulum body 380 extends vertically upward, FIG. 12 shows the state of the driving module 302 when the pendulum body 380 is moved to the left by a maximum angle, and FIG. 13 shows the state of the driving module 302 when the pendulum body 380 is moved to the right by a maximum angle.

Referring to FIG. 11, when the rotation body 350 is rotated, the third joint 362 is moved to the left along a first line P. As the first link 360 extends to the left from the third joint 362, the first joint 363 is moved to the left, and the second link 370 connected to the first joint 363 is also moved to the left.

Accordingly, the pendulum body 380 connected through the second link 370 and the second joint 384 is rotated counterclockwise along a second line Q with respect to the rotation shaft R of the fixed spray tube 160.

At this time, the third joint 362 may be located above the first joint 363, and located above the second joint 384.

Referring to FIG. 12, the third joint 362, which had been moved to the left along the first line P, changes direction to the right. The second link 370 connected to the first link 360 through the first joint 363 is also moved to the right. Accordingly, the pendulum body 380 connected to the second link 370 through the second joint 384 changes the movement direction to clockwise along a second line Q with respect to the rotation shaft R of the fixed spray tube 160. At a point at which the second joint 384 switches the movement direction from counterclockwise to clockwise, the pendulum body 380 disposed in the left side may be inclined by a first angle θ1, which is a maximum angle, with respect to upper and lower shafts, and the pendulum body 380 disposed in the right side may be inclined by a second angle θ2, which is a maximum angle, with respect to upper and lower shafts. At this time, the third joint 362 is moved to the lower side than the first joint 363, and located in the upper side than the second joint 384.

Referring to FIG. 13, the third joint 362, which had moved to the right along the first line P, changes direction to the left. The second link 370 connected to the first link 360 through the first joint 363 is also moved to the right. Accordingly, the pendulum body 380 connected to the second link 370 through the second joint 384 changes the movement direction to counterclockwise along the second line Q with respect to the rotation shaft R of the fixed spray tube 160. At a point at which the second joint 384 switches the movement direction from clockwise to counterclockwise, the pendulum body 380 disposed in the left side may be inclined by a third angle 93, which is a maximum angle, with respect to upper and lower shafts, and the pendulum body 380 disposed in the right side may be inclined by a fourth angle 94, which is a maximum angle, with respect to upper and lower shafts. At this time, the third joint 362 is moved to the upper side than the first joint 363, and located in the upper side than the second joint 384.

When the third joint 362 is moved in the circumferential direction along the first line P by the rotation of the power shaft 336, by the above-described method, the pendulum body 380 is reciprocally rotated while periodically switching the movement direction between the counterclockwise direction and the clockwise direction on the second line Q.

Figure 14:
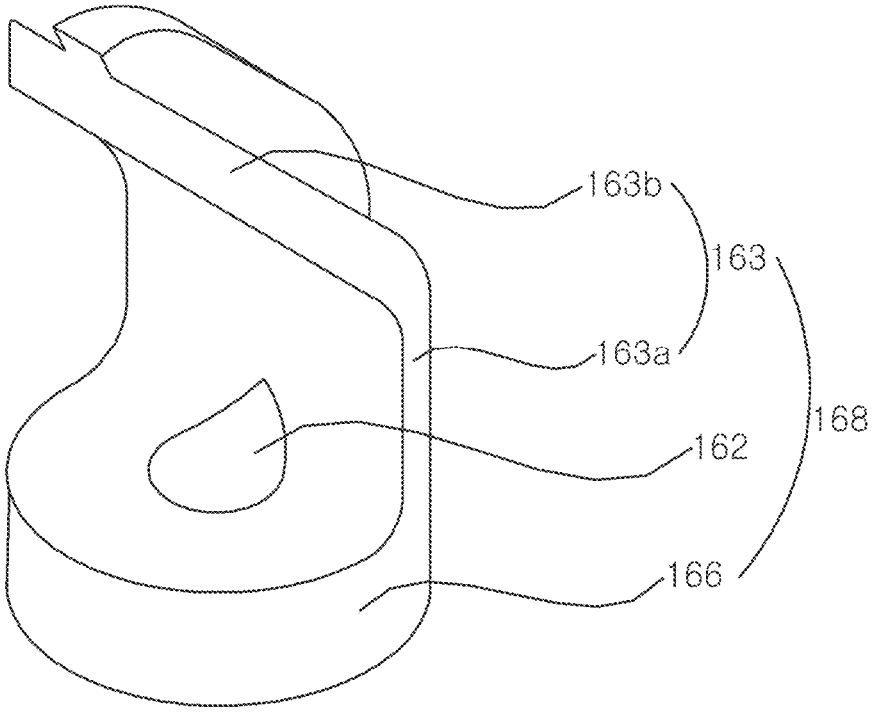
FIG. 14 is a perspective view of a spray nozzle according to an embodiment of the present disclosure.
Figure 15:
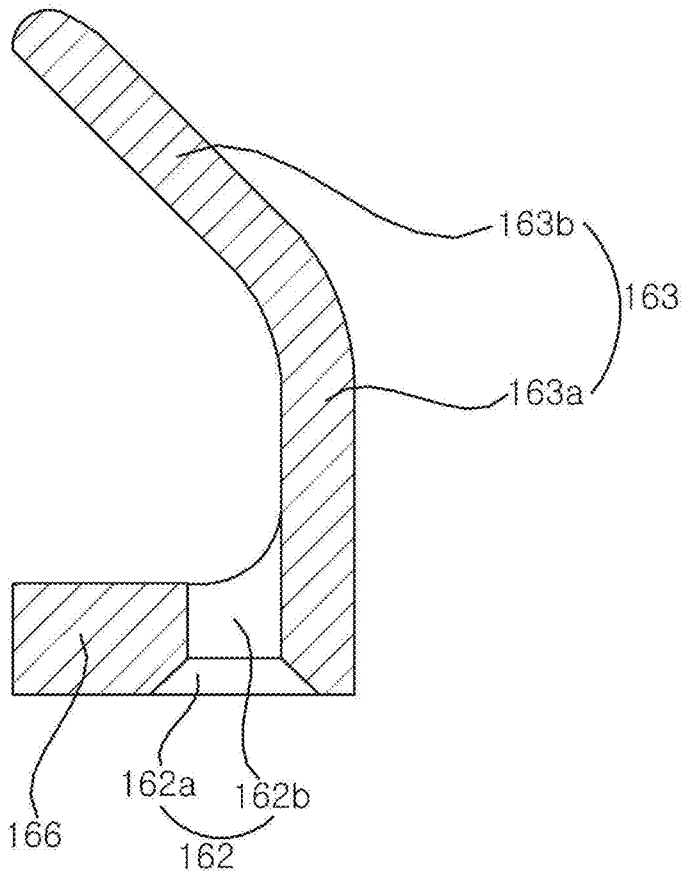
FIG. 15 is a longitudinal cross-sectional view of a spray nozzle according to an embodiment of the present disclosure.

Hereinafter, a spray nozzle 168 according to an embodiment of the present disclosure will be described with reference to FIGS. 14 and 15. FIG. 14 shows the overall outer shape of the spray nozzle 168, and FIG. 15 shows the longitudinal cross-sectional shape of the spray nozzle 168.

The spray nozzle 168 may include a nozzle base 166 connected to the tube body 161, a nozzle hole 162 opened in the up-down direction in the nozzle base 166, a first spray wall 163*a* extending from the nozzle base 166 toward the rack 110, 120, and a second spray wall 163*b* extending obliquely toward the rack 110, 120 from the first spray wall 163*a*.

The nozzle base 166 may be formed as one body with the tube body 161. The first spray wall 163*a* and the second spray wall 163*b* may be formed as one body to form a spray wall 163. The spray wall 163 may extend obliquely upward from the tube body 161.

The nozzle hole 162 may include a nozzle inlet end 162*a* constituting a lower portion of the nozzle hole 162; and a nozzle discharge end 162*b* constituting an upper portion of the nozzle hole 162. The diameter of the nozzle inlet end 162*a* may be larger than the diameter of the nozzle discharge end 162*b*. The washing water flowed into the nozzle inlet end 162*a* may be accelerated at the nozzle discharge end 162*b* and ejected toward the spray wall 163.

The washing water ejected through the nozzle hole 162 may strike the second spray wall 163*b*, and then be guided by the second spray wall 163*b* to be sprayed radially toward the rack 110, 120. The washing water sprayed radially toward the rack 110, 120 may be sprayed over a wider area of the rack 110, 120 due to pendulum motion of the spray tube 160.

Although the present disclosure has been described with reference to specific embodiments shown in the drawings, it is apparent to those skilled in the art that the present description is not limited to those exemplary embodiments and is embodied in many forms without departing from the scope of the present disclosure, which is described in the following claims. These modifications should not be individually understood from the technical spirit or scope of the present disclosure.

The invention claimed is:

1. A dishwasher comprising:

a washing tub including a rack configured to accommodate a washing object;

a spray tube including (i) a rotation shaft extending in a direction intersecting upper and lower shafts, and (ii) a spray nozzle configured to eject flowing washing water in a direction intersecting the rotation shaft;

a power applying device configured to generate power; and a driving module coupled to the spray tube and configured to transmit the power generated by the power applying device to the spray tube, wherein the driving module comprises:

a rotation body rotatably coupled to the power applying device, a pendulum body extending from the spray tube in a direction intersecting the rotation shaft and configured to oscillate in a pendulum motion around the rotation shaft, and a conversion link coupled to the rotation body and the pendulum body and configured to convert a rotational motion of the rotation body into a pendulum motion of the pendulum body.

2. The dishwasher of claim 1, wherein the conversion link comprises:

a first link coupled to the rotation body, and configured to move along a circumferential direction of the rotation body; and a second link coupled to the first link and the pendulum body, respectively.

3. The dishwasher of claim 2, wherein the first link includes a first joint protruding from the first link and coupled to the second link, and wherein the second link includes a second joint groove configured to accommodate a pendulum link, and is bent at least once between the first joint and the second joint groove.

4. The dishwasher of claim 2, wherein a plurality of spray tubes are disposed to be spaced apart in a length direction of the rack, wherein a plurality of pendulum bodies are disposed to be coupled to the plurality of spray tubes respectively, and wherein the second link is coupled to each of the plurality of pendulum bodies.

5. The dishwasher of claim 2, wherein the second link comprises:

a first frame which extends in an up-down direction, and is coupled to the first link; and a second frame which extends in a direction intersecting the first frame, and is coupled to the pendulum body.

6. The dishwasher of claim 5, wherein a length of the first frame is shorter than a length of the second frame.

7. The dishwasher of claim 2, wherein the rotation body comprises:

a power shaft coupled to the power applying device; and a third joint groove which is disposed at a position spaced apart from the power shaft in a radial direction, and configured to accommodate the first link.

8. The dishwasher of claim 7, wherein the first link comprises:

a first joint protruding from the first link and coupled to the second link; and a third joint coupled to the rotation body, wherein the pendulum body includes a second joint protruding from the pendulum body and coupled to the second link, and wherein the third joint is configured to move along the circumferential direction of the rotation body and change a relative vertical position with respect to the first joint, and is disposed at a location higher than the second joint.

9. The dishwasher of claim 8, wherein the second joint is coupled to the second link at an upper side of the rotation shaft, and configured to move in a pendulum motion around the rotation shaft.

10. The dishwasher of claim 1, wherein the spray tube comprises a connector protruding toward the pendulum body, and wherein the pendulum body comprises a pendulum body hole configured to accommodate the connector.

11. The dishwasher of claim 10, wherein the pendulum body comprises:

a holder extending to surround the pendulum body hole; and a pendulum link extending from the holder in a direction intersecting the spray tube.

12. The dishwasher of claim 1, wherein the power applying device comprises an impeller having a plurality of blades spaced apart from each other in a circumferential direction.

13. The dishwasher of claim 12, further comprising a washing pump configured to pass the washing water to the spray tube and the impeller.

14. The dishwasher of claim 1, wherein the power applying device comprises a gear train including (i) a driven gear coupled to the rotation body and (ii) a driving gear coupled to the driven gear.

15. The dishwasher of claim 1, further comprising a blocking block, wherein the power applying device is disposed at one side of the blocking block, and the driving module is disposed at the other side of the blocking block.

16. The dishwasher of claim 15, wherein the blocking block includes a recessed groove defined at one side of the blocking block, the recessed groove configured to accommodate the driving module, and wherein the rotation body is disposed at the recessed groove.

17. The dishwasher of claim 1, wherein the rack comprises:

a first wire extending upward; and a second wire extending upward to intersect the first wire, and defines a spray space between the first wire and the second wire, wherein the spray tube is disposed at the spray space.

18. The dishwasher of claim 1, further comprising a blocking block in which the power applying device and the driving module are disposed, wherein the blocking block includes a fastening boss protruding toward the rack and coupled to the rack.

19. The dishwasher of claim 1, further comprising a supporter disposed at a location spaced apart from the driving module in a width direction of the spray tube, wherein the supporter includes:

a support block coupled to the rack; and a bearing fixed to the support block and rotatably coupled to the spray tube.

20. The dishwasher of claim 1, wherein the spray nozzle comprises:

a first spray wall extending from the spray tube toward the rack; and a second spray wall extending from the first spray wall toward the rack.

* * * * *